US009750293B1

(12) United States Patent
Lang

(10) Patent No.: US 9,750,293 B1
(45) Date of Patent: Sep. 5, 2017

(54) WAISTBAND TIGHTENING DEVICE AND METHOD

(71) Applicant: Harold C. Lang, Houston, TX (US)

(72) Inventor: Harold C. Lang, Houston, TX (US)

( * ) Notice: Subject to any disclaimer, the term of this patent is extended or adjusted under 35 U.S.C. 154(b) by 381 days.

(21) Appl. No.: 13/760,052

(22) Filed: Feb. 6, 2013

Related U.S. Application Data

(60) Provisional application No. 61/633,111, filed on Feb. 6, 2012.

(51) Int. Cl.
*A41F 18/00* (2006.01)

(52) U.S. Cl.
CPC ..... *A41F 18/00* (2013.01); *Y10S 24/909* (2013.01); *Y10S 24/91* (2013.01); *Y10T 24/2164* (2015.01); *Y10T 24/2191* (2015.01); *Y10T 24/2194* (2015.01)

(58) Field of Classification Search
CPC ..... Y10T 24/2194; Y10T 24/2191; Y10T 24/2164; F16G 11/12; Y10S 24/91; Y10S 24/909
USPC ..... D11/210; 24/71.1, 68 F
See application file for complete search history.

(56) References Cited

U.S. PATENT DOCUMENTS

| | | | | | |
|---|---|---|---|---|---|
| 166,640 | A | * | 8/1875 | Seymour | 24/68 F |
| 179,872 | A | * | 7/1876 | Seymour | 24/68 F |
| 1,574,857 | A | * | 3/1926 | Barneck | 24/910 |
| 2,090,005 | A | * | 8/1937 | Kendzy | 24/71.1 |
| 2,229,003 | A | | 1/1941 | Fly | |
| 2,267,235 | A | | 12/1941 | Ginnel | |
| 2,840,879 | A | * | 7/1958 | Boice | 24/570 |
| 2,849,773 | A | | 9/1958 | Kaselow | |
| 3,242,542 | A | * | 3/1966 | Tako | 24/68 F |
| 5,937,489 | A | * | 8/1999 | Gunter | 24/71.1 |
| 6,305,056 | B1 | | 10/2001 | Hubner | |

* cited by examiner

*Primary Examiner* — Robert J Sandy
(74) *Attorney, Agent, or Firm* — Kenneth A. Roddy

(57) ABSTRACT

A waistband tightening device has a generally horizontal crank arm with a first and second leg at one end extending vertically therefrom in parallel spaced relation defining a vertical slot therebetween, and a fastener element at the opposed end disposed in outwardly spaced relation to the legs. The device is installed downward onto the waistband with the legs straddling the waistband, and the crank arm and fastener element are rotated in a clockwise or counter-clockwise direction with the slot being the center of rotation such that the waistband becomes looped partially around the first and second legs and upon further rotation becomes wound around both of the legs to reduce the circumference of the waistband and thereafter the fastener element is engaged on an inner or outer facing surface of the waistband to prevent unwinding and maintain the waistband in a tightened condition.

3 Claims, 3 Drawing Sheets

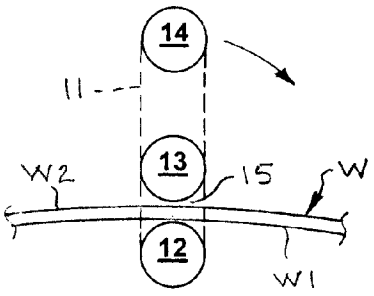
Fig. 5A
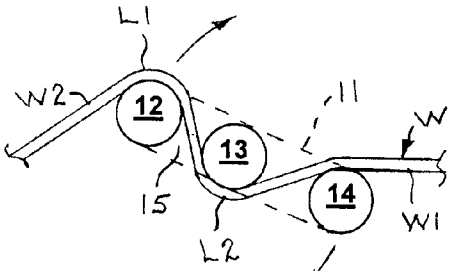
Fig. 5B
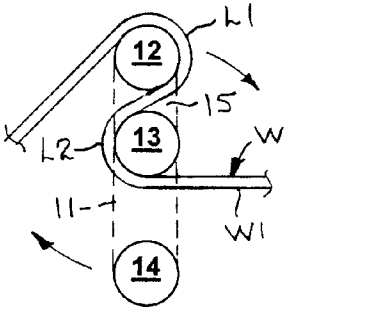
Fig. 5C
Fig. 5D
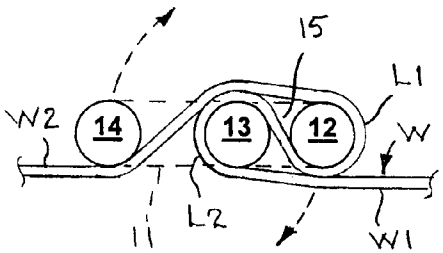
Fig. 5E
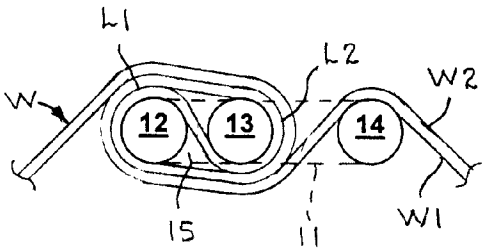
Fig. 5F

WAISTBAND TIGHTENING DEVICE AND METHOD

CROSS REFERENCE TO RELATED APPLICATION

This application claims priority of U.S. Provisional Application Ser. No. 61/633,111, filed Feb. 6, 2012.

BACKGROUND OF THE INVENTION

1. Field of the Invention

This invention relates generally to waistband adjustment devices and, more particularly, to a unitary waistband tightening device having two parallel vertical legs adjoined at top ends to a top portion having a crank arm and is slidably received on the waistband of a garment and rotated thereon to reduce the circumference of the waistband and tighten it around the waist of the wearer and thereafter the crank arm is received on the waistband to prevent unwinding of the waistband.

2. Background Art

Garments, such as trousers and skirts, have a waistband that encircles the waist of the wearer. If the waistband is inelastic, typically, a belt is used to tighten the waistband around the wearer's waist, or in the case of trousers, suspenders may be fastened to the front and back of the waistband and worn over the wearer's shoulders to hold the trousers up and maintain the waistband at the waistline. A belt must be laced through belt loops and placed under tension around the waist, and can induce perspiration in warm weather. Suspenders must be clipped or otherwise fastened to the front and back of the waistband, placed over the shoulders, and adjusted in length to maintain the waistband at the wearer's waistline. Thus, both belts and suspenders are uncomfortable and cumbersome.

There are several patents directed toward various types of waistband adjustment devices adapted to take up the slack of the waistband and eliminate the necessity of using a belt or suspenders.

Fly, U.S. Pat. No. 2,229,003, discloses a garment strap adjuster comprising a relatively long and substantially flat member, having a transverse slot intermediate its ends, substantially rectangular eyes in the flat portions of the member intermediate the slot and the opposite ends of the member, and other slots, one connecting each of the eyes with the corresponding end of the member. The outer ends of the other slots flare outwardly, the outer edges of the eyes are offset at the opposite sides of the slots at the ends of the member.

Ginnel, U.S. Pat. No. 2,267,235, discloses a garment support in the form of a strap member or abbreviated or elastic belt adapted to be arranged at the inner side of the waistband, and attached to the waistband at opposite sides thereof to extend across the back of the wearer. The elastic strap is attached to the waistband by a clip fastener at each end. The clips are formed with spaced apart teeth extending from a cross-piece and adapted to be slid over a free edge of the garment material with a plurality of teeth disposed on one side of the material and at least one intermediate tooth disposed on the other side thereof.

Kaselow, U.S. Pat. No. 2,849,773, discloses a waistband tightening device comprising an elongated, relatively flat main body member, respective first flat prongs rigidly secured to the ends of the main body and extending perpendicular thereto, and a plurality of relatively flat, longitudinally spaced second prongs rigidly secured to the main body member parallel to and spaced inwardly from the first prongs having enlarged rounded ends that are adapted to be interengaged with the waistband of a garment to shorten the waistband.

Hubner, U.S. Pat. No. 6,305,056 discloses an apparatus for adjusting the width of a waistband, which includes a U-shaped clip that slides onto the waistband perpendicularly to the longitudinal direction of the waistband. The U-shaped clip has two limbs which are interconnected on the top sides thereof and which run substantially parallel to each other. The waistband is arranged in a fold formed by the waist band passing by the clip, substantially parallel thereto, first to one limb of the clip. The waistband loops around the first limb before running back in an opposite direction, between the two limbs of the clip, to the second limb. The waistband further loops around the second limb before finally being guided back in the opposite direction. The clip has vertically extending parallel arms at each side that fit on a respective outer flank of the folded waistband on a side facing away from the U-shaped clip, to prevent the clip from rotating and the waistband from unfolding.

SUMMARY OF THE INVENTION

The present invention overcomes the aforementioned problems and is distinguished over the prior art in general, and these patents in particular by a waistband tightening device having a generally horizontal crank arm portion with first and second ends, a first leg and a second leg at the crank arm first end extending vertically therefrom in parallel spaced relation defining a vertical slot therebetween open at a bottom end, and a fastener element at the crank arm second end disposed in outwardly spaced relation to the first leg and the second leg.

The waistband tightening device is installed downward onto the waistband with the waistband received in the slot and the first leg and second leg straddling the waistband, and the crank arm portion and fastener element are rotated in a clockwise or counterclockwise direction with the slot being the center of rotation such that the waistband becomes looped partially around the first and second legs and upon further rotation becomes wound around both of the first and second legs to reduce the circumference of the waistband and thereafter the fastener element is engaged on an inner facing surface or outer facing surface of the waistband to prevent unwinding and maintain the waistband in a tightened condition.

One of the significant features and advantages of the present waistband tightening device is that it allows a user to easily and quickly take up the slack of a garment waistband and eliminate the necessity of using a belt or suspenders.

Another feature and advantage of the present waistband tightening device is that it is does not require any alteration of the existing waistband.

Another feature and advantage of the present waistband tightening device is that it does not require a separate clip to prevent unwinding of the waistband or to maintain the waistband in a tightened condition.

Another feature and advantage of the present waistband tightening device is that it is relatively small, smooth, has no sharp edges or surfaces, and is comfortable to wear on the waistband.

A further feature and advantage of the present waistband tightening device is that it is of simple construction, inexpensive to manufacture, and rugged and reliable in operation.

Other significant features and advantages of the invention will become apparent from time to time throughout the specification and claims as hereinafter related.

BRIEF DESCRIPTION OF THE DRAWINGS

FIG. 5A is a schematic top plan view of the first embodiment of the waistband tightening device, shown initially placed onto the waistband of a garment with the legs shown in transverse cross section and the top portion shown in dashed line FIGS. 5B and 5C are top plan views of the waistband tightening device on the waistband, shown being rotated in a clockwise direction to engage the first and second legs on the waistband and form a pair of loops in a section of the waistband.

FIG. 5D is a top plan view of the waistband tightening device on the waistband, shown being further rotated in a clockwise direction to engage a looped portion on a section of the waistband and wind it around both legs of the device and reduce the circumference of the waistband.

FIG. 5E is a top plan view of the waistband tightening device on the waistband, showing the loops around both legs and a section of the waistband wound around both legs with the crank arm engaged on the outer facing surface of the waistband to prevent it from unwinding and maintain the waistband in a tightened condition.

FIG. 5F is a top plan view of the waistband tightening device on the waistband, shown further rotated in a clockwise direction with an additional length of the waistband wound around both legs of the device to further reduce the circumference of the waistband with the crank arm placed on the inner facing side of the waistband to prevent unwinding of the waistband and maintain the waistband in a tightened condition.

DESCRIPTION OF THE PREFERRED EMBODIMENTS

Figure 1:
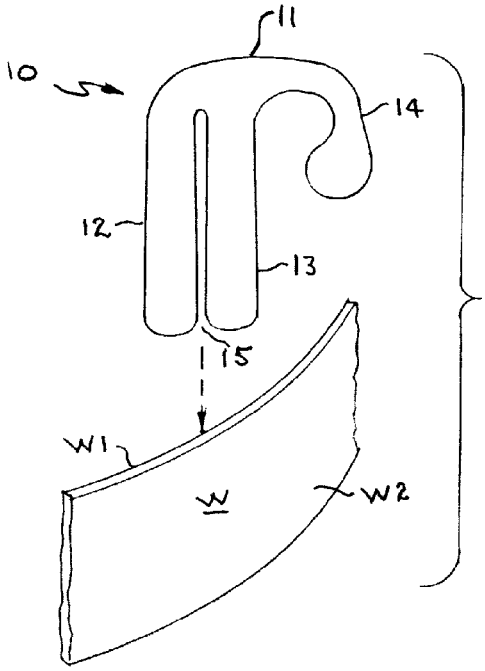
FIG. 1 is an isometric view of the waistband tightening device in accordance with a first embodiment of the present invention.
Figure 4:
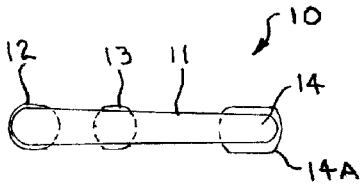
FIG. 4 is a top plan view of the waistband tightening device.
Figure 2:
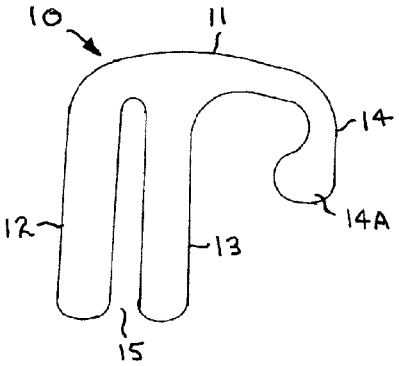
FIG. 2 is a side elevation view of the waistband tightening device.
Figure 3:
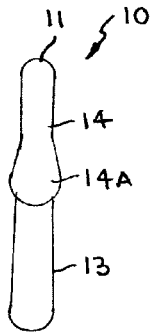
FIG. 3 is an end view of the waistband tightening device, shown from the outer end of the crank arm portion.

Referring to the drawings by numerals of reference, there is shown in FIGS. 1-4, a first preferred embodiment of a waistband tightening device 10. In this embodiment, the device 10 is of unitary construction and has a generally horizontal crank arm portion 11 with a contiguous first leg 12 depending vertically from one end thereof, a second leg 13 depending vertically therefrom in parallel inwardly spaced relation to the first leg, and a shorter outer leg or handle/fastener 14 depending a short distance vertically downward from the opposed end of the crank arm in outwardly spaced relation to the second leg. The space between the first leg 12 and the second leg 13 defines a vertical slot 15 extending from the crank arm portion 11 and open at the bottom end.

In a preferred embodiment, but not limited thereto, the crank arm portion 11 of the device 10 is of an arcuate configuration, the upper portion of the contiguous first leg 12 adjoins the arcuate crank arm portion 11 in a curved radius, and the shorter outer leg or handle/fastener 14 adjoins the opposed end of the arcuate crank arm portion 11 in a curved radius and terminates in a rounded bulbous bottom end 14A. The first leg 12, the second leg 13, and handle/fastener 14, may be circular, elliptical, or semicircular in transverse cross section, and preferably the first and second legs have rounded bottom ends.

In a preferred embodiment, but not limited thereto, the overall height of the device 10 from the top of the crank arm portion 11 to the bottom of the legs 12 and 13 may be approximately 30 mm or about 17/32"; the length from end to end of the crank arm portion 11 and handle/fastener 14 of the device 10 may be approximately 16.2 mm or about 5/8"; the vertical slot 15 may be approximately 25.3 mm or about 1" in length and approximately 3.7 mm or about 5/32" wide; and the rounded bulbous bottom end 14B of the handle/fastener 14 may terminate a distance of approximately 14.2 mm or about 9/16" above the bottom ends of the legs 12 and 13.

Operation

Referring now to FIGS. 5A-5F, the first embodiment of the device 10 is shown somewhat schematically with the legs in transverse cross section and the crank arm portion 11 shown in dashed line to more clearly illustrate the steps in installing the device and tightening the waistband.

While wearing the garment, and holding the device 10 between the thumb and finger of one hand with the handle/fastener 14 facing outward from the waist, the wearer slides the device 10 downward onto the top of the waistband W such that the waistband is received in the slot 15 and the first leg 12 and the second leg 13 straddle the waistband (FIG. 5A). In this initial placement, the first leg 12 is disposed between wearer's waist and the inner facing surface W1 of the waistband W, the second leg 13 is disposed closely adjacent to the outer facing surface W2 of the waistband, and the handle/fastener 14 is disposed a short distance outward from the second leg 13. The wearer may use his or her free hand to pull the waistband W outward from their waist to facilitate initial placement of the device 10 onto the waistband, and rotation. It is suggested that a convenient location for placement is above one of the front pockets or on a side near the front of the garment.

After the device 10 has been installed on the waistband W, the outwardly facing crank arm 11 and handle/fastener 14 is gripped between the thumb and finger, and the device is rotated in a clockwise or counterclockwise direction. In the illustrated example, the device is shown rotated in a clockwise direction. As the crank arm 11 rotates, the slot 15 becomes the center of rotation, the legs 12 and 13 engage the waistband W (FIGS. 5B, 5C) and the waistband becomes looped partially around the first leg 12 and the second leg 13 with one loop L1 being pulled outward and clockwise relative to the wearer's waist and the other loop L2 pulled inward and clockwise relative to the waist (FIG. 5D).

In order to facilitate rotation, the wearer may use their free hand to move the upper portion of the waistband out of the path of the depending handle/fastener 14 during rotation, and/or angle the crank arm slightly upward such that the depending handle/fastener clears the waistband during rotation.

As rotation continues, and after approximately one complete rotation, the loops L1 and L2 become overlapped and the waistband W becomes wound around both of the legs 12 and 13 (FIG. 5E). At this point, the circumference of the waistband W is reduced, and becomes tighter around waist of the wearer, and the handle/fastener 14 is disposed closely adjacent to the outer facing surface W2 of the waistband W. Then, the handle/fastener 14 is release to become engaged on the outer facing surface W2 of the waistband W and serve as a fastener to prevent unwinding of the waistband and maintain the waistband in a tightened condition (FIG. 5E).

If additional tightness is desired, the device 10 may be rotated through another half rotation, and then the handle/fastener 14 is engaged on the inner facing surface W1 of the waistband W to prevent unwinding of the waistband and maintain the waistband in a tightened condition (FIG. 5F), or another full rotation with the handle/fastener 14 engaged on the outer facing surface W2 of the waistband W (not shown). Alternatively, two devices 10 may be used, for example, one on installed above each of the front pockets, respectively, or on both sides near the front of the waistband.

It has been found that left-handed wearers may prefer to place the device 10 on the waistband above the left pocket and rotate the device in a counterclockwise direction.

Figure 6:
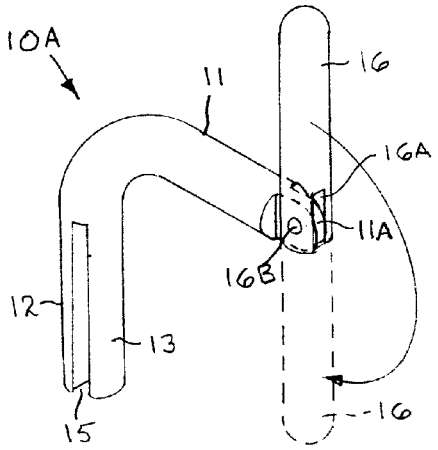
FIG. 6 is a perspective view of an a second embodiment of the waistband tightening device having a crank arm and a pivoting handle/fastener, shown in an upwardly pivoted position, and shown in dashed line in a downwardly pivoted position, respectively.

Referring to FIG. 6, there is shown a second embodiment of the waistband tightening device 10A having a rotatable crank arm portion 11 and a pivoting handle/fastener 16. The components that have been described previously are assigned the same numeral of reference. In this embodiment, the waistband tightening device 10A has a generally horizontal crank arm portion 11 with a contiguous first leg 12 depending vertically from a first end thereof, and a second leg 13 depending vertically therefrom in parallel inwardly spaced relation to the first leg. The space between the first leg 12 and the second leg 13 defines a vertical slot 15 extending from the crank arm portion 11 and open at the bottom end. In this embodiment, the opposed second end of the crank arm portion 11 terminates in a short outwardly extending tongue portion 11A of reduced width. The handle/fastener 16 is a short rod that has a slot 16A at one end that is received on the tongue portion 11A and pivotally connected thereto by a pivot pin 16B. As with the previous embodiment, the crank arm portion 11 of the device 10A may be of an arcuate configuration. As shown in FIG. 6, in an upwardly pivoted position, the handle/fastener 16 extends a short distance vertically upward from the end of the crank arm portion 11 and serves as a handle to facilitate rotating the waistband tightening device 10A in a clockwise or counterclockwise direction to wind the waistband around the first and second legs, as described above with reference to the first embodiment. As shown in dashed line, in a downwardly pivoted position, the handle/fastener 16 depends a short distance vertically downward from the outer end of the crank arm portion 11 in generally parallel outwardly spaced relation to the first and second legs 12 and 13 to engage the inner or outer facing surface of the waistband and serve as a fastener to prevent unwinding of the waistband and maintain the waistband in a tightened condition, as described above with reference to the first embodiment.

Figure 7:
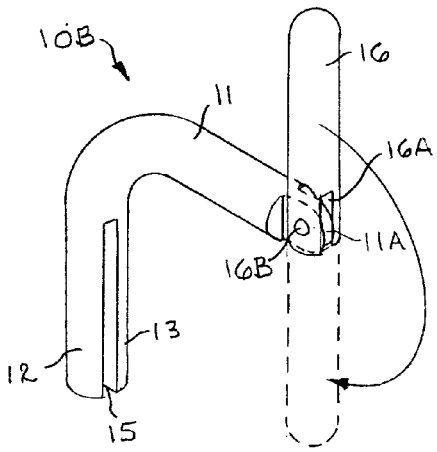
FIG. 7 is a perspective view of a third embodiment of the waistband tightening device having a crank arm and a pivoting handle/fastener, similar to FIG. 6, with the handle/fastener shown in an upwardly pivoted position, and shown in dashed line in a downwardly pivoted position, respectively.

FIG. 7 is a perspective view of a third embodiment of the waistband tightening device 10B having a rotatable crank arm portion 11 and a pivoting handle/fastener 16 similar to FIG. 6. The components that have been described previously are assigned the same numerals of reference. In this embodiment, the waistband tightening device 10B has a generally horizontal crank arm portion 11 with a contiguous first leg 12 depending vertically from a first end thereof, and a second leg 13 depending vertically therefrom in parallel spaced relation to the first leg. The space between the first leg 12 and the second leg 13 defines a vertical slot 15 extending from the crank arm portion 11 and open at the bottom end. As with the previous embodiment, the opposed second end of the crank arm portion 11 terminates in a tongue portion 11A of reduced width. The first end of the crank arm portion 11 adjoins the top ends of the first and second legs 12 and 13 and extends outwardly in a plane above the slot 15. Thus, in this embodiment, the first and second legs 23 and 13 are disposed laterally in a plane transverse to the axis of the outwardly extending crank arm portion 11.

As with the previous embodiment, the handle/fastener 16 is a short rod that has a slot 16A at one end that is received on the tongue portion 11A and pivotally connected thereto by a pivot pin 16B. As with the previous embodiment, the crank arm portion 11 of the device 10A may be of an arcuate configuration. As shown in FIG. 7, in an upwardly pivoted position, the handle/fastener 16 extends a short distance vertically upward from the second end of the crank arm portion 11 and serves as a handle to facilitate rotating the waistband tightening device 10B in a clockwise or counterclockwise direction to wind the waistband around the first and second legs, as previously described with reference to the first embodiment. As shown in dashed line, in a downwardly pivoted position, the handle/fastener 16 depends a short distance vertically downward from the outer end of the crank arm portion 11 in outwardly spaced relation to the legs 12 and 13 to engage the inner or outer facing surface of the waistband and serve as a fastener to prevent unwinding of the waistband and maintain the waistband in a tightened condition, as previously described with reference to the first embodiment.

Figure 8:
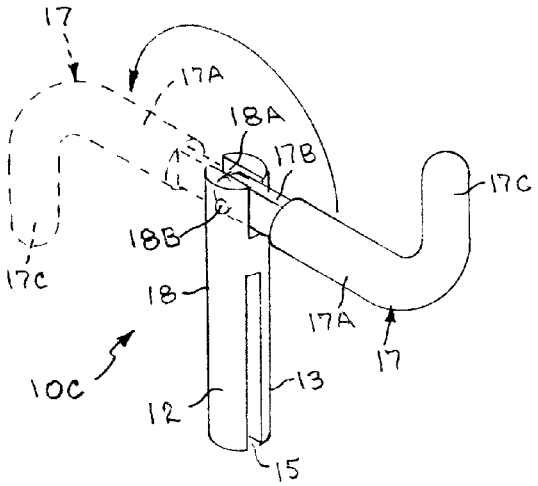
FIG. 8 is a perspective view of a fourth embodiment of the waistband tightening device having a generally L-shaped pivoting crank arm and handle/fastener, with the crank arm and handle/fastener shown in an upwardly pivoted position, and shown in dashed line in a downwardly pivoted position, respectively.

FIG. 8 is a perspective view of a fourth embodiment of the waistband tightening device 10C having a generally L-shaped rotatable and pivoting crank arm 17. The components that have been described previously are assigned the same numerals of reference. In this embodiment, the first leg 12 and second leg 13 of the waistband tightening device 10C are adjoined together at their upper ends by a contiguous top portion 18 and depend vertically therefrom in parallel spaced relation. The space between the first leg 12 and the second leg 13 defines a vertical slot 15 extending from the top portion 18 and open at the bottom end. In this embodiment, the top portion 18 has a short vertical slot 18A extending downwardly from the top end thereof and terminating a short distance above the slot 15 between the legs. The generally L-shaped pivoting crank arm 17 has a first leg 17A with a tongue portion 17B of reduced width at one end that is received in the short vertical slot 18A in the top portion 18 and pivotally connected thereto by a pivot pin 18B at a point between the first and second legs 12 and 13 and above the slot 15. The first leg 17A of the crank arm 17 extends a distance outward from the pivot connection and terminates in a second leg 17C disposed generally perpendicular thereto. In this embodiment the perpendicular second leg 17C functions as the handle/fastener.

Similar to the previous embodiment, the top portion 18 and the first and second legs 12 and 13 are disposed laterally in a plane transverse to the axis of the outwardly extending first leg 17A of the crank arm 17. As shown in FIG. 8, in an upwardly pivoted position, the first leg 17A of the crank arm 17 extends generally horizontally outward from the top portion 18 of the legs and its second leg 17C extends a short distance vertically upward from the outer end of the outwardly extending first leg and serves as a handle to facilitate rotating the waistband tightening device 10C in a clockwise or counterclockwise direction to wind the waistband around the first and second legs, as previously described with reference to the first embodiment. As shown in dashed line, in a downwardly pivoted position, the crank arm is pivoted approximately 180° about the pivot connection such that its first leg 17A extends generally horizontally outward from the top portion 18 in the opposite direction and its second leg 17C extends a short distance vertically downward from the outer end thereof in outwardly spaced relation to the legs 12 and 13 to engage the inner or outer facing surface of the waistband and serve as a fastener to prevent unwinding of the waistband, as previously described with reference to the first embodiment.

Figure 9:
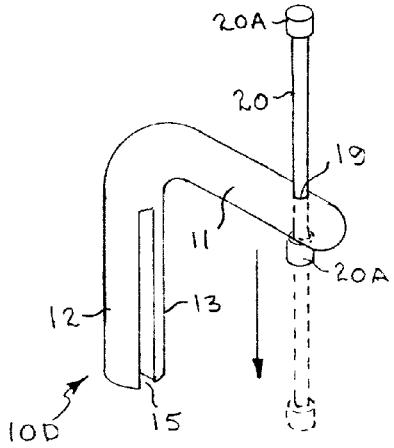
FIG. 9 is a perspective view of a fifth embodiment of the waistband tightening device having a crank arm with a vertical pin handle/fastener slidably mounted in the outer end, with the pin shown in a raised position, and shown in dashed line in a lowered position, respectively.

FIG. 9 is a perspective view of another alternate embodiment of the waistband tightening device 10D. The components that have been described previously are assigned the same numerals of reference. In this embodiment, the waistband tightening device 10D has a generally horizontal crank arm portion 11 with a contiguous first leg 12 and second leg 13 adjoined to one end thereof and depending vertically therefrom in parallel spaced relation. The space between the first leg 12 and the second leg 13 defines a vertical slot 15 extending from the crank arm portion 11 and open at the bottom end. In this embodiment, the crank arm portion 11 adjoins the first and second legs 12 and 13 and extends horizontally outward therefrom in a plane above the slot 15. Similar to the previous embodiment, the first and second legs 12 and 13 are disposed laterally in a plane transverse to the axis of the outwardly extending crank arm portion 11. A vertical hole 19 extends through the crank arm portion 11 near its outer end. In this embodiment, the handle/fastener is a vertical pin 20 slidably mounted in the hole 19, and having a small protuberance 20A at each end to prevent the pin from being completely withdrawn from the hole and becoming lost. As shown in FIG. 9, in a raised position, the pin 20 extends a short distance vertically upward from the outer end of the outwardly extending crank arm portion 11 and serves as a handle to facilitate rotating the waistband tightening device 10D in a clockwise or counterclockwise direction to wind the waistband around the first and second legs, as previously described with reference to the first embodiment. As shown in dashed line, in a lowered position, the pin 20 extends a short distance vertically downward from the outer end of the outwardly extending crank arm portion 11 in outwardly spaced relation to the legs 12 and 13 to engage the inner or outer facing surface of the waistband and serve as a fastener to prevent unwinding of the waistband, as previously described with reference to the first embodiment.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A device for tightening the waistband of a garment, comprising:

a waistband tightening device of unitary construction having a generally horizontal crank arm portion with first and second ends;

a first leg and a second leg at said crank arm first end depending vertically therefrom in parallel horizontally spaced relation in the same plane defining a straight vertical slot therebetween open at a bottom end; and a third shorter fastener leg depending vertically from said crank arm second end disposed in parallel outwardly spaced relation to, and in the same plane as, said first leg and said second leg and terminating in a bottom end spaced a distance vertically above bottom ends of said first leg and said second leg;

said first leg and said second leg configured to be received downward onto the waistband with the waistband received in said slot and said first leg and said second leg straddling the waistband, said crank arm portion and said shorter fastener leg configured to be rotated in a clockwise or counterclockwise direction with said slot being the center of rotation such that the waistband becomes looped partially around said first and second legs and upon further rotation becomes wound around both of said first and second legs to reduce the circumference of the waistband, and said shorter fastener leg configured to be engaged on an inner facing surface or outer facing surface of the waistband to prevent unwinding and maintain the waistband in a tightened condition.

2. A device for tightening the waistband of a garment, comprising:

a waistband tightening device of unitary construction having a horizontal generally arcuate crank arm portion with first and second ends;

a first leg depending vertically from said crank arm first end and a second leg depending vertically from said crank arm portion in parallel inwardly spaced relation to said first leg defining a vertical slot therebetween open at a bottom end; and a fastener element depending a short distance downward from said crank arm second end disposed in parallel outwardly spaced relation to said second leg terminating in a rounded bulbous bottom end;

said first leg and said second leg configured to be received downward onto the waistband with the waistband received in said slot and said first leg and said second leg straddling the waistband, said crank arm portion and said fastener element configured to be rotated in a clockwise or counterclockwise direction with said slot being the center of rotation such that the waistband becomes looped partially around said first and second legs and upon further rotation becomes wound around both of said first and second legs to reduce the circumference of the waistband, and said fastener element configured to be engaged on an inner facing surface or outer facing surface of the waistband to prevent unwinding and maintain the waistband in a tightened condition.

3. The device according to claim 2, wherein said rounded bulbous bottom end terminates in a plane a distance above bottom ends of said first and second legs.

* * * * *